US006249175B1

(12) United States Patent
Ebana

(10) Patent No.: US 6,249,175 B1
(45) Date of Patent: Jun. 19, 2001

(54) SELF-BIASING CIRCUIT

(76) Inventor: Takeo Ebana, c/o Mitsubishi Electric Engineering Co., Ltd. 6-2, Otemachi 2-chome, Chiyoda-ku, Tokyo 100-0004 (JP)

( * ) Notice: Subject to any disclaimer, the term of this patent is extended or adjusted under 35 U.S.C. 154(b) by 0 days.

(21) Appl. No.: 09/496,461

(22) Filed: Feb. 2, 2000

(30) Foreign Application Priority Data

Sep. 24, 1999 (JP) ..... 11-270361

(51) Int. Cl.[7] ..... G05F 1/10
(52) U.S. Cl. ..... 327/538; 327/513
(58) Field of Search ..... 323/315, 316; 327/538, 539, 540, 541, 543, 513

(56) References Cited

U.S. PATENT DOCUMENTS 4,605,892 * 8/1986 Seevinck et al. ..... 323/315
4,792,748 * 12/1988 Thomas et al. ..... 323/313
4,882,533 * 11/1989 Kelley ..... 323/313

FOREIGN PATENT DOCUMENTS 440316 4/1992 (JP) .
5324108 12/1993 (JP) .

* cited by examiner

*Primary Examiner*—Jeffrey Zweizig

(57) ABSTRACT

In a self-biasing circuit, a reference current having a positive temperature characteristic and a reference current having a negative temperature characteristic are generated using one NPN transistor. The temperature response of the circuit is corrected by generating a combined reference current that is the sum of the reference currents having positive and negative temperature characteristics with a low driving voltage at a low current in a simple circuit.

6 Claims, 5 Drawing Sheets

SELF-BIASING CIRCUIT

FIELD OF THE INVENTION

The present invention relates to a self-biasing circuit which generates a constant current (a constant voltage) for generating a bias current and a bias voltage of a functional circuit. More particularly, this invention relates to a self-biasing circuit capable of correcting temperature characteristics.

BACKGROUND OF THE INVENTION

FIG. 3 is a circuit diagram that shows a structure of a conventional self-biasing circuit. In this conventional self-biasing circuit, a reference circuit consisting of NPN transistors 1 and 2 generates a potential difference Δ VBE (=VBE1−VBE2) based on a base-emitter voltage VBE1 of the transistor 1 and a base-emitter voltage VBE2 of the transistor 2, and generates a reference current IREF1 based on the Δ VBE and a resistor 3 (having a resistance R3). A PNP transistor mirror section connected to the transistors 1 and 2 sees to it that a desired reference output current IREFOUT is generated based on the reference current IREF1.

Assuming that the mirror ratio of the PNP transistor mirror section is 1, the reference current IREF1 is expressed by the following expression.

$$IREF1=\Delta VBE/R3=(VT\times 1nN)/R3 \quad (1)$$

where VT denotes a thermal voltage, and N denotes a ratio of the areas of emitters of the transistors 1 and 2, that is, a mirror ratio of the transistors 1 and 2.

As explained above, the reference current IREF1 can be set at a free value according to the mirror ratio N of the transistors 1 and 2, the mirror ratio of the PNP transistor mirror section as a current supply section, and the resistance R3 of resistor 3.

Further, the thermal voltage VT in the expression (1) can be given by the following expression.

$$VT=k\times T/q+tm \quad (2)$$

where k denotes Boltzmann constant, T denotes absolute temperature, and q denotes amount of charge. is If temperature coefficient of a resistor is neglected because it is very small, the reference current IREF1 shows positive temperature characteristics from the thermal voltage VT. In other words, the value of reference current IREF1 increases as the temperature increases, and the value of reference current IREF1 decreases as the temperature decreases. Accordingly, the self-biasing circuit itself has positive temperature characteristics.

FIGS. 4 and 5 are circuit diagrams that show the structures of other conventional self-biasing circuits. The self-biasing circuit shown in FIG. 4 corrects the above-described temperature characteristics by adding a band-gap circuit 17 to the self-biasing circuit shown in FIG. 3. The self-biasing circuit shown in FIG. 5 corrects the temperature characteristics by adding a circuit 18 having negative temperature characteristics to the self-biasing circuit shown in FIG. 3. The negative temperature characteristics refers to such characteristics that the current value and the like fall along with an increase in temperature, and the current value and the like increase along with a fall in temperature.

The conventional self-biasing circuit shown in FIG. 3, however, has a problem that it cannot correct the temperature characteristics, as this self-biasing circuit does not have means for correcting the temperature characteristics. Further, the conventional self-biasing circuit shown in FIG. 4 has a problem that it is costlier and it requires a large power consumption, as this self-biasing circuit has a large area and a large circuit current in a temperature characteristics correcting section (a band-gap circuit 17) for correcting the temperature characteristics. Further, the conventional self-biasing circuit shown in FIG. 5 has a problem that it is difficult to drive at a low voltage and it requires a large power consumption, as a temperature characteristics correcting section (a circuit 18) requires a voltage equal to or above 2 VBE (a base-emitter voltage of the transistor) plus Vsat (a saturation voltage of the transistor).

While various performances have been desired in ICs in the communications field in recent years, particularly, there has been strongly desired a reduction in power consumption that determines communication time of a portable telephone and others. Therefore, attentions have been paid to circuits of low-voltage driving and low-power consumption.

SUMMARY OF THE INVENTION

The present invention has been made in light of the problems described above. It is an object of the present invention to provide a self-biasing circuit capable of having desired temperature characteristics by correcting the temperature characteristics while reducing cost and power consumption.

According to one aspect of the present invention, a self-biasing circuit generates a reference current having positive temperature characteristics and a reference current having negative temperature characteristics using the same transistor. Thus, it is possible to correct the temperature characteristics by making a reference current generated that is the sum of the reference currents having positive and negative temperature characteristics by a low-voltage driving and low-current circuit using a simple structure.

According to another aspect of the present invention, a resistor for flowing a reference current having negative temperature characteristics is connected to the base of a transistor for generating a reference current having positive temperature characteristics. Thus, it is possible to correct the temperature characteristics by making a reference current generated that is the sum of the reference currents having positive and negative temperature characteristics by a low-voltage driving and low-current circuit in a simple structure.

According to still another aspect of the present invention, a fifth transistor flows positive and negative reference currents through a first resistor and a second resistor. Thus, it is possible to correct the temperature characteristics by making a reference current generated that is the sum of the reference currents having positive and negative temperature characteristics by a low-voltage driving and low-current circuit in a simple structure.

Other objects and features of this invention will become apparent from the following description with reference to the accompanying drawings.

DESCRIPTION OF THE PREFERRED EMBODIMENTS

Embodiments of a self-biasing circuit according to the present invention will be explained below in detail with reference to the attached drawings. However, the present invention is not limited to these embodiments.

Figure 1:
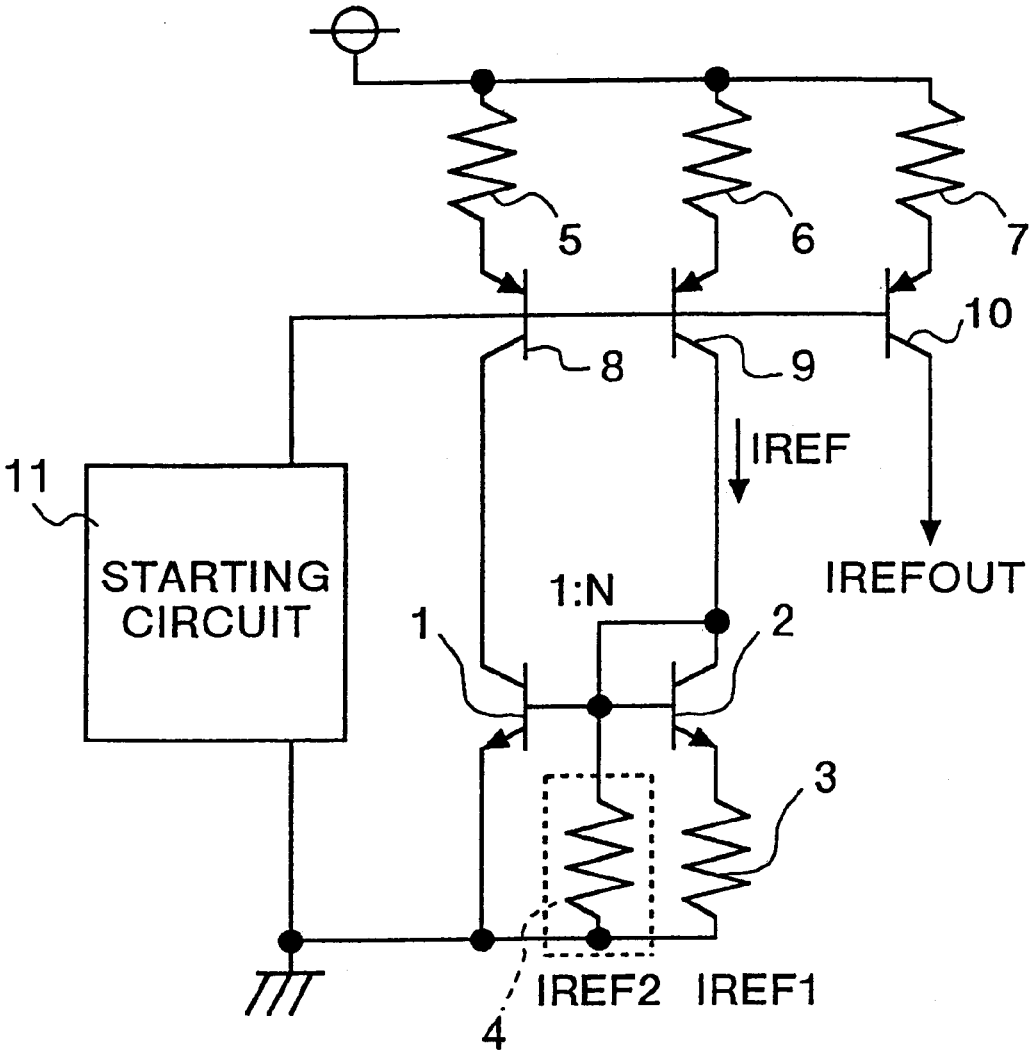
FIG. 1 is a circuit diagram showing the structure of a self-biasing circuit relating to a first embodiment of the present invention.
Figure 3:
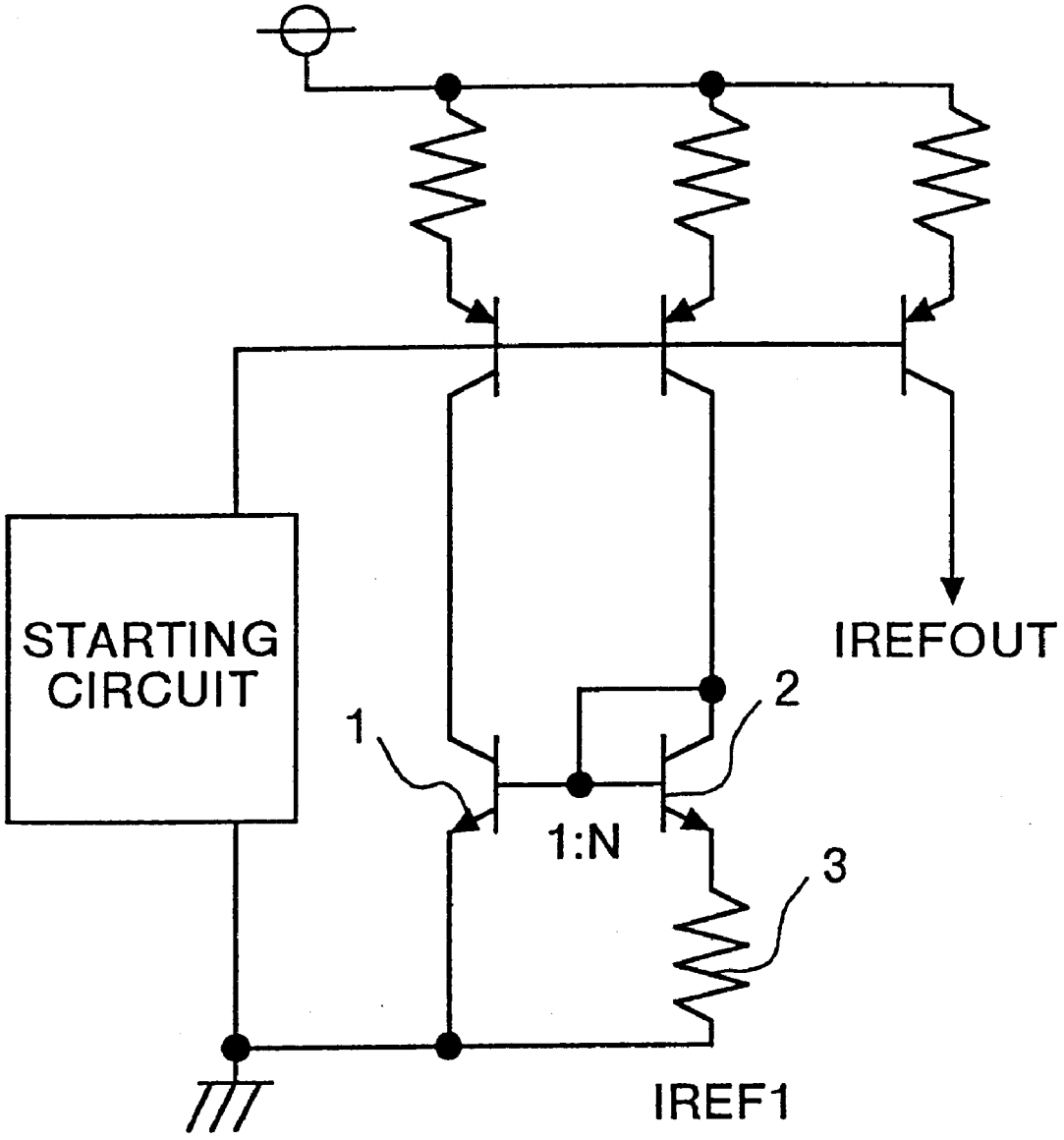
PRIOR ART FIG.3
FIG. 3 is a circuit diagram showing the structure of a self-biasing circuit according to a conventional technique.
Figure 4:
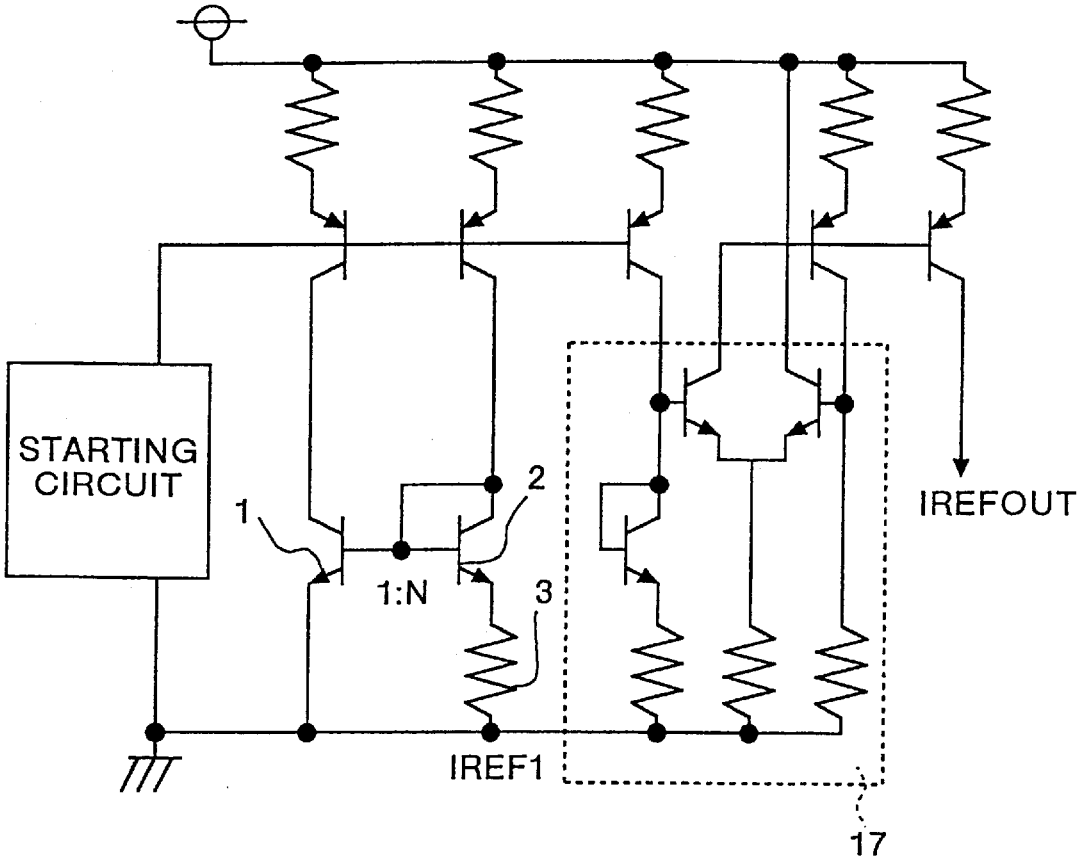
PRIOR ART FIG.4
FIG. 4 is a circuit diagram showing the structure of a self-biasing circuit according to another conventional technique.
Figure 5:
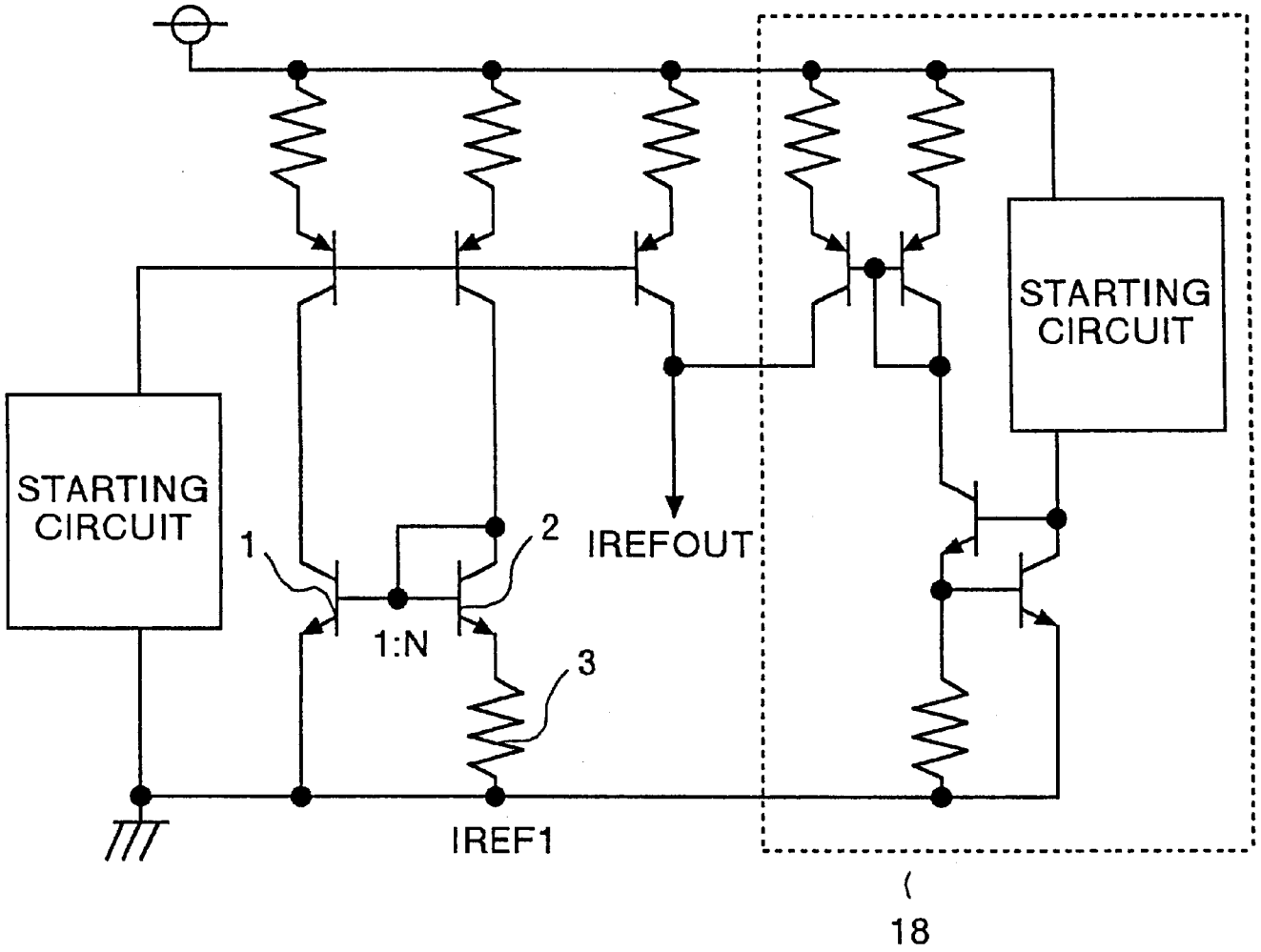
FIG.5 PRIOR ART
FIG. 5 is a circuit diagram showing the structure of a self-biasing circuit according to a still another conventional technique.

FIG. 1 is a circuit diagram showing the structure of a self-biasing circuit relating to a first embodiment of the present invention. The same sign is put on the element corresponding to each element in FIG. 3. The self-biasing circuit relating to the first embodiment includes NPN transistors 1 and 2, resistors 3, 4, 5, 6 and 7, PNP transistors 8, 9 and 10, and a circuit starting section (a starting circuit) 11. A reference current having positive temperature characteristics flowing through the resistor 3 is expressed as IREF1, and a reference current having negative temperature characteristics flowing through the resistor 4 is expressed as IREF2. A combined reference current that is a sum of these reference currents is expressed as IREF, and a desired reference output current generated by the combined reference current IREF is expressed as IREFOUT.

The PNP transistors 8, 9 and 10 form a current mirror circuit, and the PNP transistor 10 outputs the reference output current IREFOUT. The NPN transistor 1 has its collector terminal connected to the collector terminal of the PNP transistor 8, and has its emitter terminal grounded. The NPN transistor 2 has its collector terminal connected to the collector terminal of the PNP transistor 9, the base terminal of the NPN transistor 1 and the base terminal of the NPN transistor 2 itself. The resistor 3 is disposed between the emitter terminal of the NPN transistor 2 and the ground, and the resistor 4 is disposed between the base terminals of the NPN transistors 1 and 2 and the ground.

The operation of the first embodiment will be explained below. The self-biasing circuit relating to the first embodiment generates a potential difference Δ VBE (=VBE1−VBE2) based on a base-emitter voltage VBE1 of the transistor 1 and a base-emitter voltage VBE2 of the transistor 2, and generates a reference current IREF1 based on the Δ VBE and the resistor 3 (the resistance R3), in a similar manner to the conventional example. At the same time, the self-biasing circuit flows the reference current IREF2 based on the resistor 4 (a resistance R4) connected to the base terminals of the transistors 1 and 2. Then, the self-biasing circuit obtains the combined reference current IREF that is the sum of these reference currents. In this case, the reference currents IREF1, IREF2 and the combined reference current IREF are expressed by the following expressions.

$$IREF1=\Delta VBE/R3=(k\times T/q)lnN/R3 \quad (3)$$

$$IREF2=VBE1/R4 \quad (4)$$

$$IREF = IREF1 + IREF2 \quad (5)$$

$$= (k*T/q)\ln N/R3 + VBE1/R4$$

As is understood from the above expressions (3) to (5), the reference current IREF1 has positive temperature characteristics. As VBE1 has negative temperature characteristics, the reference current IREF2 also has negative temperature characteristics. By the combined reference current IREF that is the sum of these reference currents IREF1 and IREF2 having positive and negative temperature characteristics, it is possible to obtain desired temperature characteristics. In other words, it is easily possible to obtain desired temperature characteristics by adjusting the mirror ratio N and the resistance values R3 and R4. It is also possible to reduce dependence on temperature by canceling the temperature characteristics.

Further, the resistor 4 lowers the impedance of the collector section of the NPN transistor 2, controls the phase status of the node, and restricts the phase rotation of the oscillation generated between the PNP transistors 8 and 9 and the NPN transistors 1 and 2.

As described above, according to the first embodiment, it is not necessary to separately add a circuit for requiring a high voltage. Therefore, it is possible to start the operation at VBE (abase-emitter voltage of the transistor) plus Vsat (a saturation voltage of the transistor), so that it is possible to drive at a low voltage. For example, when VBE=0.7 V and Vsat=0.2 V, then, it is possible to operate at 1 V or a lower voltage. Further, as the same NPN transistor generates the reference currents IREF1 and IREF2 having positive and negative temperature characteristics, it is possible to restrict a variation in currents due to the variation in elements. Therefore, desired characteristics can be obtained.

Further, as the currents can be combined by the generating section of the reference current, it is possible to reduce power consumption. Further, as the temperature characteristics can be corrected by only adding the resistor 4 without separately providing a temperature characteristics correcting section that requires a large area, it is possible to reduce cost. Further, by the resistor 4, it is possible to obtain the effect of restricting the phase rotation of oscillation as well as the effect of correcting the temperature characteristics. Thus, it is also possible to measure oscillation in the circuit.

The self-biasing circuit is a circuit that is capable of providing a stable supply of currents with minimum variation in power source voltage. In the first embodiment, it is further possible to stabilize the operation by correcting the temperature characteristics and restricting oscillation in a low-voltage driving and low-current circuit of a simple structure.

Figure 2:
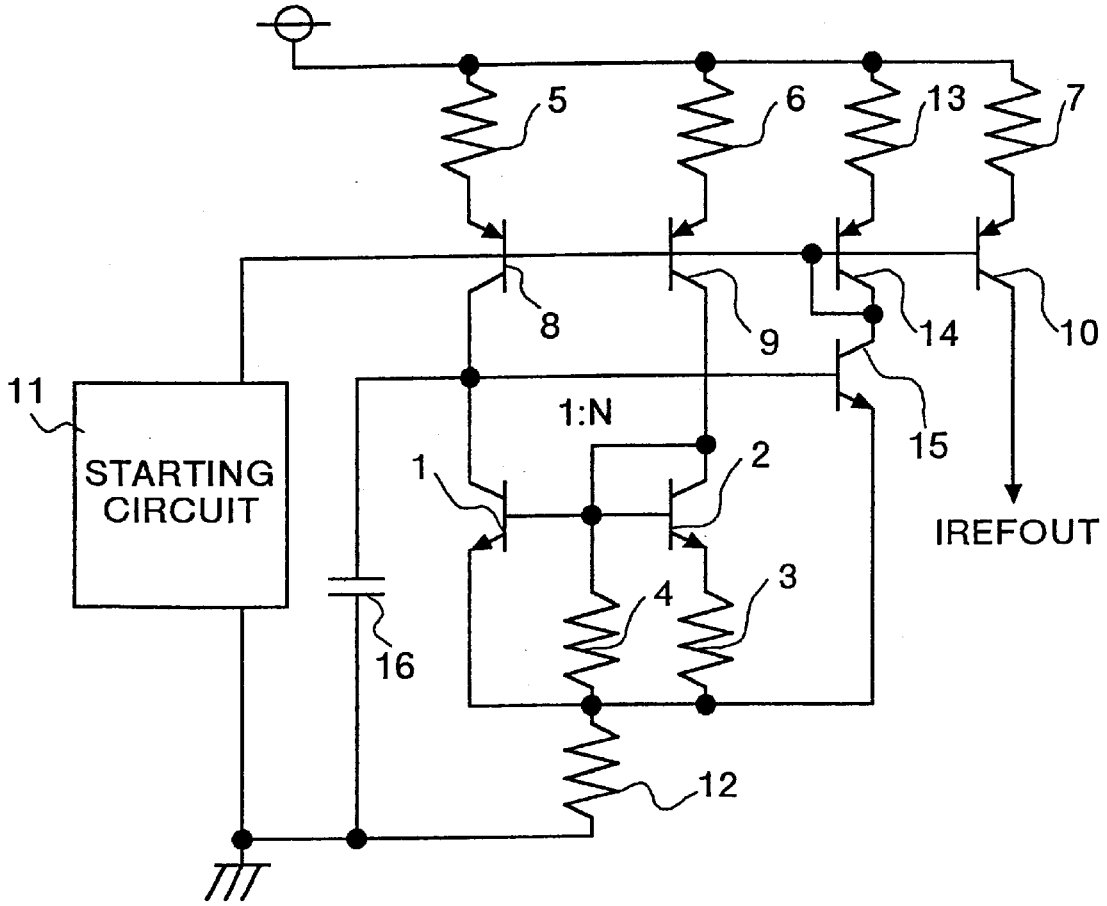
FIG. 2 is a circuit diagram showing the structure of a self-biasing circuit relating to a second embodiment of the present invention.

In general, in a self-biasing circuit, it is important to restrict oscillation. A second embodiment further provides a measure of restricting oscillation to the first embodiment. The measure of restricting oscillation in the second embodiment will be explained with reference to FIG. 2. FIG. 2 is a circuit diagram showing the structure of a self-biasing circuit relating to the second embodiment of the present invention. The same signs are provided to the elements that are the same to those shown in FIG. 1, and to avoid the repetition their explanation will be omitted. The self-biasing circuit of the second embodiment includes resistors 12 and 13, a PNP transistor 14, an NPN transistor 15 and a capacitor 16, in addition to the structure of the first embodiment.

The resistor 12 is disposed between the emitter terminal of the NPN transistor 1, the emitter terminal of the NPN transistor 15, and the resistors 3 and 4, and the ground. The resistor 13 is disposed between the emitter of the PNP transistor 14 and the power source. The PNP transistor 14 has its base terminal connected in common to the bases of the PNP transistors 8, 9 and 10, and also to its own collector terminal and the collector terminal of the NPN transistor 15. The NPN transistor 15 has its base terminal connected to the collector terminal of the NPN transistor 1. The capacitor 16 is disposed between the collector terminal of the NPN transistor 1 and the ground.

The resistors 12 and 13, the PNP transistor 14 and the capacitor 16 have the role of restricting the oscillation of the self-biasing circuit. The NPN transistor 15 has the role of arranging the collector current of the NPN mirror circuit. By the addition of the resistor 4, it is also possible to obtain the effect of restricting the phase rotation of oscillation as well as the effect of correcting the temperature characteristics.

As described above, in the second embodiment, it is possible to obtain a stable circuit operation by restricting the oscillation based on the oscillation countermeasure as well as to obtain an effect similar to that of the first embodiment.

As explained above, according to one aspect of the present invention, the self-biasing circuit generates a reference current having positive temperature characteristics and a reference current having negative temperature characteristics using the same transistor. Thus, it is possible to correct the temperature characteristics by making a reference current generated that is the sum of the reference currents having positive and negative temperature characteristics by a low-voltage driving and low-current circuit in a simple structure. Accordingly, there is obtained an effect that it is not necessary to separately provide a configuration for correcting the temperature characteristics, which configuration generally requires a large area, a large current and a high voltage.

According to another aspect of the present invention, a resistor for flowing a reference current having negative temperature characteristics is connected to the base of the transistor for generating a reference current having positive temperature characteristics. Thus, it is possible to correct the temperature characteristics by making a reference current generated that is the sum of the reference currents having positive and negative temperature characteristics by a low-voltage driving and low-current circuit in a simple structure. Accordingly, there is obtained an effect that it is not necessary to separately provide a configuration for correcting the temperature characteristics, which configuration generally requires a large area, a large current and a high voltage.

According to still another aspect of the present invention, the fifth transistor flows positive and negative reference currents through the first resistor and the second resistor. Thus, it is possible to correct temperature characteristics by making a reference current generated that is the sum of the reference currents having positive and negative temperature characteristics by a low-voltage driving and low-current circuit in a simple structure. Accordingly, there is obtained an effect that it is not necessary to separately provide a configuration for correcting the temperature characteristics, which configuration generally requires a large area, a large current and a high voltage.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A self-biasing circuit comprising:

a current mirror circuit having a first transistor, a second transistor, and a third transistor for producing an output current, each of said first, second, and third transistors having respective emitters, bases, and collectors;

a fourth transistor having an emitter, a base, and a collector, the collector being connected to the collector of said first transistor;

a fifth transistor having an emitter, a base, and a collector, the collector being connected to the bases of said fifth and fourth transistors and to the collector of said second transistor;

a first resistor connected between the emitters of said fourth and fifth transistors, for flow of a reference current having a positive temperature characteristic; and a second resistor connected between the bases of said fourth and fifth transistors and the emitter of said fourth transistor for flow of a reference current having a negative temperature characteristic.

2. The self-biasing circuit of claim 1 wherein the emitter of said fourth transistor is connected to ground and said first and second resistors are respectively connected between the emitter of said fifth transistor and the bases of said fourth and fifth transistors and ground.

3. The self-biasing circuit of claim 2 including respective resistors connecting the emitters of said first, second, and third transistors to a power supply voltage.

4. The self-biasing circuit of claim 1 further including:

a sixth transistor having an emitter, a base, and a collector, the base being connected to the bases of said first and second transistors and to the collector of said sixth transistor; and a seventh transistor having an emitter, a base, and a collector, the collector being connected to the collector of said sixth transistor, the base being connected to the collector of said fourth transistor, and the emitter being connected to the emitter of said fourth transistor and to said first and second resistors.

5. The self-biasing circuit of claim 4 further including:

a third resistor connected between ground and the emitter of said fourth transistor and between ground and said first and second resistors; and a capacitor connected between ground and the collector of said fourth transistor for suppressing oscillation of said self-biasing circuit.

6. The self-biasing circuit of claim 4 including respective resistors connected between the emitters of said first, second, third, and sixth transistors and a power supply voltage.

* * * * *

UNITED STATES PATENT AND TRADEMARK OFFICE

CERTIFICATE OF CORRECTION

PATENT NO. : 6,249,175 B1
DATED : June 19, 2001
INVENTOR(S) : Takeo Ebana

It is certified that error appears in the above-identified patent and that said Letters Patent is hereby corrected as shown below:

Title page,
Item [73], insert the following Assignee as follows:
-- [73] Assignee: Mitsubishi Denki Kabushiki Kaisha. Tokyo, Japan and

Mitsubishi Electric Engineering Co., Ltd. Tokyo, Japan --

Signed and Sealed this

Ninth Day of July, 2002

*Attest:*

*Attesting Officer*

JAMES E. ROGAN
*Director of the United States Patent and Trademark Office*